US005113329A

United States Patent [19]

Lin

[11] Patent Number: 5,113,329

[45] Date of Patent: May 12, 1992

[54] TUBE LIGHT

[76] Inventor: Tak-Huei Lin, P.O. Box 79-65, Taipei, Taiwan

[21] Appl. No.: 609,534

[22] Filed: Nov. 1, 1990

Related U.S. Application Data

[63] Continuation-in-part of Ser. No. 535,397, Jun. 7, 1990, Pat. No. 4,999,755.

[51] Int. Cl.[5] ..... F21S 1/02

[52] U.S. Cl. ..... 362/238; 362/219; 362/249; 362/800

[58] Field of Search ..... 362/145, 219, 236, 237, 362/238, 249, 800

[56] References Cited

U.S. PATENT DOCUMENTS

| | | | |
|---|---|---|---|
| 4,195,330 | 3/1980 | Savage, Jr. | 362/800 |
| 4,364,107 | 12/1982 | Wieczorek | 362/800 |
| 4,570,206 | 2/1986 | Deutsch | 362/800 |
| 4,884,178 | 11/1989 | Roberts | 362/800 |
| 4,999,755 | 3/1991 | Lin | 362/800 |

*Primary Examiner*—Ira S. Lazarus

*Assistant Examiner*—Sue Hagarman

*Attorney, Agent, or Firm*—Lyon & Lyon

[57] ABSTRACT

A tube light comprises a tube having a continuous length, a plurality of light units adapted to be secured on the tube, and a fastener for securing the light units on the tube. Each light unit comprises a socket portion of which the upper part is formed with a column having an external thread, and the column can just pass through a perforation provided on the top surface of the tube. Thereafter, the light unit can be secured on the tube by the fastener such that the external thread of the column is engaged with the internal thread of the fastener. Contacts extend from inside of the socket portion of the tube and lay on the upper surface of the socket portion so as to press against conductor strips which extend continuously underneath the top surface of the tube and can be connected with an electrical power source. The bottom of the tube is open, and after the light units are mounted on the tube, the bottom of the tube can be enclosed by a lid having a dimension conforming with the length and width of the tube.

10 Claims, 2 Drawing Sheets

TUBE LIGHT

CROSS-REFERENCE TO RELATED APPLICATION

This application is a continuation-in-part of application Ser. No. 535,397 filed June 7, 1990, now U.S. Pat. No. 4,999,755 patented Mar. 12, 1991.

FIELD OF THE INVENTION

The present invention relates to a tube light, and particularly to a light structure comprising a long tube and a plurality of light units wherein the light units are threadably secured on the tube.

BACKGROUND OF THE INVENTION

This application discloses a tube-light structure comprising a tube having a continuous length and a plurality of light units which conform to the inner configuration of the tube and can suitably be positioned anywhere in the tube. Also disclosed in this application is a tube-light structure having a cover or clips, or being provided with wings on the light units, to facilitate securing the light units in the tube.

SUMMARY OF THE INVENTION

Even though the present invention is an extension of design of said Application Ser. No. 535,397, it still involves a new concept in the arrangement of structure distinct therefrom and from the prior art. According to the present invention, each of the light units is provided with an external thread to engage an internal thread on a nut or cap (fastener) for securing the light unit on the tube. When the light units are properly mounted on the tube, a lid is provided for enclosing the bottom of the tube.

Accordingly, it is a main object of the present invention to provide an easily assembled tube-light structure so that the purchasers can "do it themselves" by simply threadably engaging the light units and the fasteners.

Another object is to provide an improved tube light structure.

DESCRIPTION OF THE PREFERRED EMBODIMENTS

Figure 1:
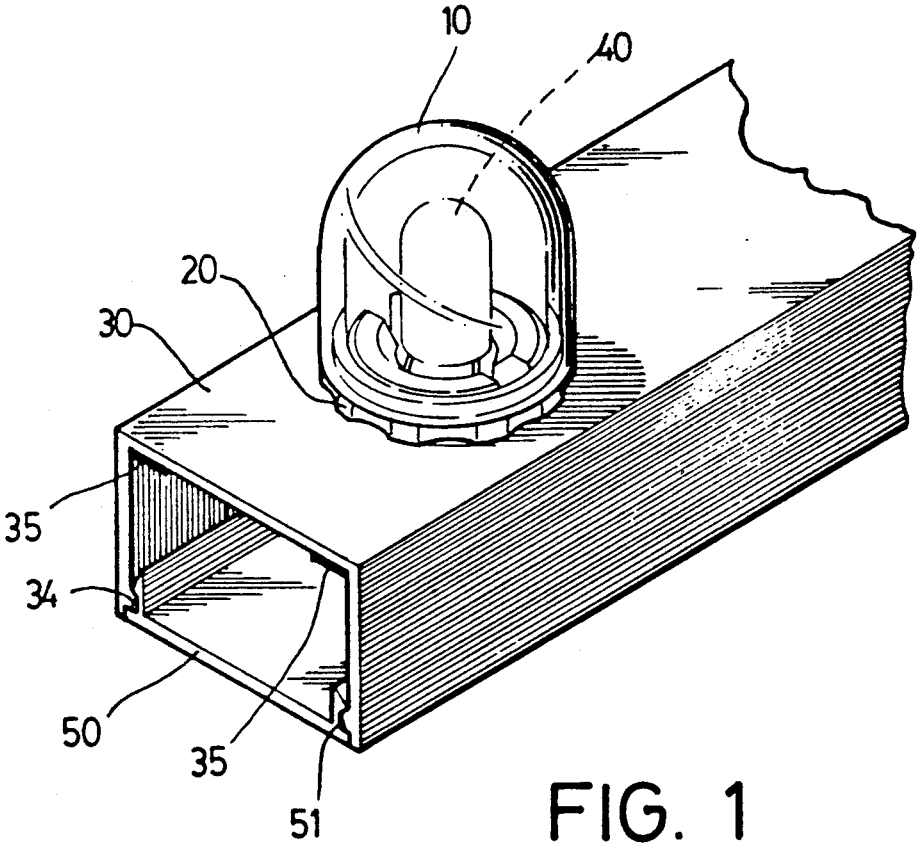
FIG. 1 is a perspective view showing a first embodiment of the invention.

The construction and function of the present invention will be described, by referring to the drawings, as follows.

Figure 2:
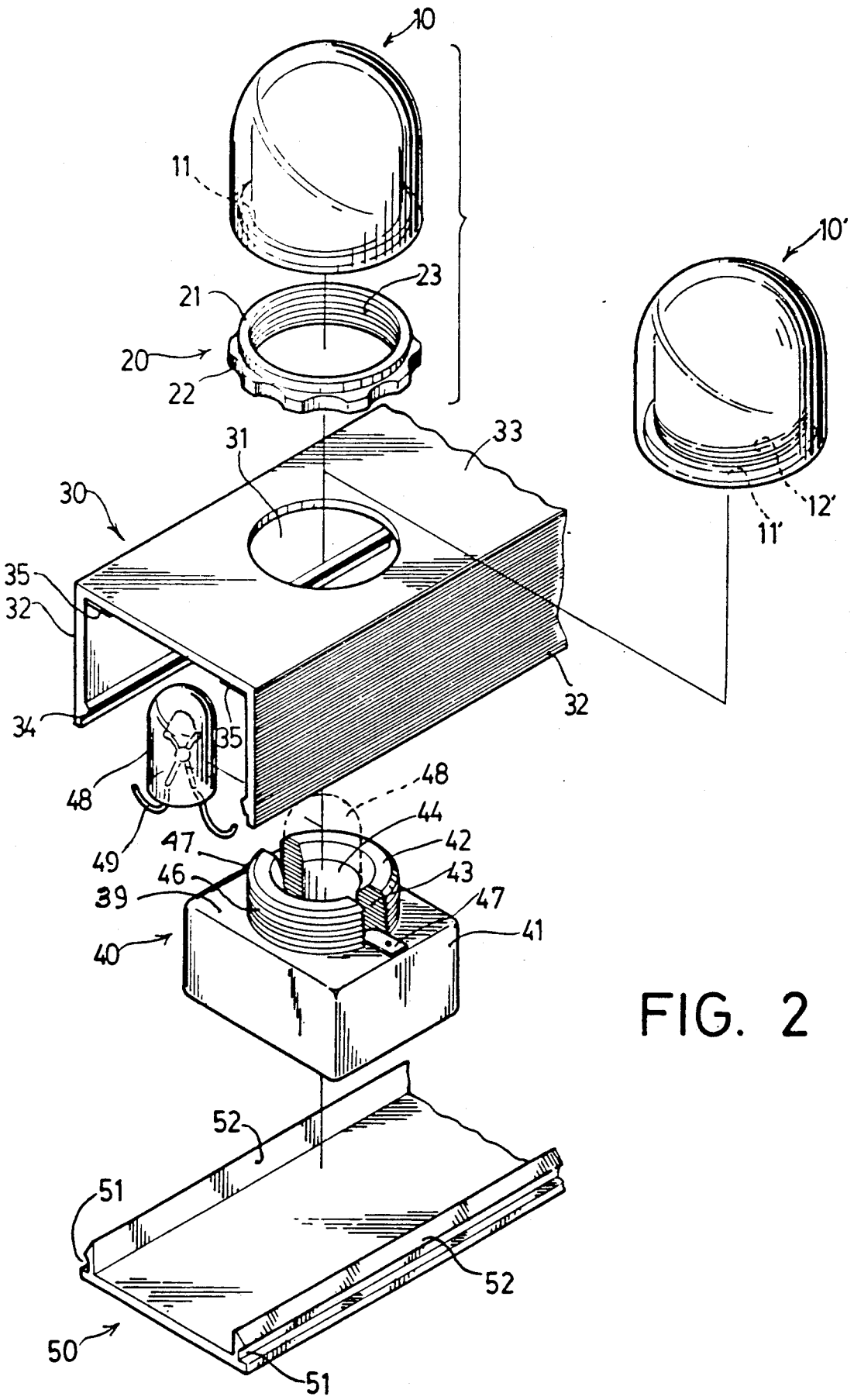
FIG. 2 is an exploded view of the invention including another cap design for a second embodiment of the invention.

As shown in FIGS. 1 and 2, the tube light according to the present invention, comprises an elongated tube 30, a plurality of light units 40, a fastener (in the first embodiment, which is a nut 20), and a lid 50. The tube 30 is a plastic continuous hollow tube having a rectangular cross-section as shown while leaving the bottom open. A plurality of round perforations 31 (see FIG. 2) are provided preferably along the center line of the top surface 33 of the tube 30 at suitable locations. The dimensions of the perforations 31 are in conformity with those of columns 42 formed at the upper portions of sockets 41. Edges 34 of the tube 30 are provided at the lower ends of the left and right sides 32 of the tube 30.

Continuous metal electrical conductor strips 35 are provided underneath the top surface 33 of the tube 30 and adjacent to the sides 32. These strips are insulated from each other by the plastic tube, and the conductor strips 35 are connected with a suitable electrical power source (not shown).

The light unit 40 comprises a socket 41 integrally made of plastic. The socket 41 extends upward, from a central portion of the upper surface 39 to form the column 42. The lower part of the socket is in the form of a rectangular parallelepiped which is suitable to be positioned in the interior of the tube 30. The column 42 is provided with a pair of opposite recesses 43 from inside of which a pair of electrical contacts 47 extended outward and lie on the upper surface 39 of the socket 41. The contacts 47 may be affixed on the socket 41 by a conventional manner such as riveting. When a bulb 48 is tightly inserted into the opening 44 of the socket 41, the electrical leads 49 of the bulb 48 will be in physical and electrical contact with the contacts 47. The contacts 47 will press upon the conductor strips 35 upon securing of the sockets 41 onto the tube 30 so as to supply electricity to the bulb 48. The column 42 which is provided with external thread 46 can pass through the perforation 31 of the tube 30.

The fastener is in the form of a nut 20 in the first embodiment (FIG. 1) of the invention. The nut 20 has an upward extending flange 21 and has a circumferentially formed portion 22 so as to facilitate turning of the nut 20 by hand. The flange 21 can be tightly engaged with the lip portion 11 of the plastic translucent cap 10. The nut 20 is provided with internal thread 23 which can be engaged with the external thread 46 of the column 41 when the column 42 is passed through the perforation 31 of the tube 30, thereby securing the light unit 40 on the tube 30.

After all the light units 40 are properly mounted on the tube 30, a lid 50 is employed for enclosing the bottom of the tube 30. The dimension of the lid 50 is in conformity with the width and length of the tube 30. In addition, the left and right sides 52 of the lid 50 are of suitable height. Grooves 51 are formed at the lower ends of the sides 52 so as to engage the edges 34 of tube 30 and secure the lid 50 to the bottom of the tube 30.

In the second embodiment of the present invention as seen in FIG. 2, a cap 10' itself acts as a fastener. In this case, the cap 10 is threaded at 12' above the lip portion 11'. This enables the cap 10', having the lip portion 11' and the thread 12', to secure the light unit 40 on the tube 30 by engaging the thread 12' directly with the thread 46 of the light unit. Although in the second embodiment the lip portion 11' of the cap 10' is not needed, it does make the cap 10' have the same structure as that of the cap 10 for exchangeability.

In view of the above, the present invention provides a simple structure of a light tube which can be readily assembled by the purchasers, and is particularly useful and practical. The aforesaid embodiments of the invention are illustrated to exemplify the present invention rather than to limit the scope of the invention. Any modification or change that is within the spirit of the present invention and equivalents thereof is intended to be covered.

What is claimed is:

1. A tube light comprising:

a length of insulating tube having an internal cross-section of substantially constant, rectangular configuration with a bottom side open, where a top surface is provided with a plurality of round perforations spaced appropriately from one another, two continuous conductor strips are each provided underneath the top surface and adjacent to left and right sides of the tube, a plurality of light units each having substantially the same size and general structure, and wherein each light unit includes a socket suitable to be located in the tube, the socket extends upward an appropriate distance to form a column which is provided at its center with an opening for receiving a bulb and a pair of recesses are each oppositely provided on the column, the column being sized to just pass through the perforation provided on the top surface of the tube, a pair of metal contacts each extend from inside of the recesses and lay on an upper surface of the socket for engaging the respective conductor strips, the metal contacts engage leads of the bulb when the bulb is disposed in the opening of the column, the circumference of the column is provided with an external thread, and a cylindrical fastener for each light unit and having an internal thread which can engage the external thread of the column when the column has passed through the perforation on the top surface of the tube so as to secure the light unit on the tube.

2. The tube light according to claim 1, wherein lower ends of the left and right sides of the tube are each formed with an edge, and further comprising a lid conforming to the length and width of the tube, wherein the lid has formed therein a left and a right side extending upward an appropriate distance and has formed therein grooves one at the lower end of the left side and one at the right side of the lid, so that the lid can enclose the bottom of the tube upon engagement of the edges and grooves.

3. The tube light according to claim 1 or 2, wherein the cylindrical fastener is in the form of a nut whose circumference is formed with a turning portion and which extends upward in the form of a flange.

4. The tube light according to claim 3, further comprising a translucent cap, a lip formed at the inner side of and adjacent to the bottom of the cap, the lip capable of being tightly engaged with the flange of the nut.

5. The tube light according to claim 1 or 2, wherein the cylindrical fastener is a translucent cap.

6. A tube light comprising a length of insulating tube having an open bottom side, a top surface having a plurality of perforations spaced from one another, and continuous conductor strips provided underneath the top surface of the tube, a plurality of light units each having substantially the same size and general structure, and wherein each light unit includes a socket sized to be located in the tube, the socket extends upward to form a column which is provided with an opening for receiving a bulb and recesses are each provided on the column, the column being sized to pass through a perforation provided on the top surface of the tube, a pair of metal contacts for engaging leads of the bulb when the bulb is disposed in the opening of the column, and the contacts each extend from inside of the recesses and lay on a surface on the socket for engaging the conductor strips of the tube, the column being provided with a thread, and a fastener for each light unit having a thread which can engage the thread of the column when the column extends through the perforation on the top surface of the tube so as to secure the light unit on the tube.

7. The tube light according to claim 6 wherein lower ends of the left and right sides of the tube are each formed with an edge, and further comprising a lid conforming to the length and width of the tube, wherein the lid has formed therein a left and a right side extending upward an appropriate distance and has formed therein grooves, one at the lower end of the left side and one at the right side of the lid, so that the lid can enclose the bottom of the tube upon engagement of the edges and grooves.

8. The tube light according to claim 6 or 7 wherein the fastener is in the form of a nut whose circumference is formed with a gripping portion and which extends upward in the form of a flange.

9. The tube light according to claim 8, further comprising a translucent cap, a lip formed at the inner side of and adjacent to the bottom of the cap, the lip capable of being tightly engaged with the flange of the nut.

10. The tube light according to claim 6 or 7 wherein the fastener is a translucent cap.

* * * * *